US009805546B2

(12) United States Patent
Glasson et al.

(10) Patent No.: US 9,805,546 B2
(45) Date of Patent: Oct. 31, 2017

(54) METHODS AND SYSTEMS FOR MONITORING GOLFERS ON A GOLF COURSE

(71) Applicant: Glasson Investments Pty Ltd, Elanora Heights (AU)

(72) Inventors: Ian Geoffrey Glasson, Elanora Heights (AU); David Sven Glasson, Geneva (CH)

(73) Assignee: GLASSON INVESTMENTS PTY LTD, New South Wales (AU)

( * ) Notice: Subject to any disclaimer, the term of this patent is extended or adjusted under 35 U.S.C. 154(b) by 703 days.

(21) Appl. No.: 14/307,508

(22) Filed: Jun. 18, 2014

(65) Prior Publication Data

US 2014/0379105 A1 Dec. 25, 2014

(30) Foreign Application Priority Data

Jun. 19, 2013 (AU) ..... 2013902224

(51) Int. Cl.
*A63B 71/06* (2006.01)
*G07F 17/32* (2006.01)
*G07F 17/38* (2006.01)

(52) U.S. Cl.
CPC ..... *G07F 17/3237* (2013.01); *G07F 17/3239* (2013.01); *G07F 17/38* (2013.01)

(58) Field of Classification Search
USPC ..... 463/31–42
See application file for complete search history.

(56) References Cited

U.S. PATENT DOCUMENTS 5,324,028 A * 6/1994 Luna ..... A63B 69/36 340/323 R
2011/0268194 A1* 11/2011 Nagano ..... H04N 13/0048 375/240.25
2012/0066721 A1* 3/2012 Long, III ..... H04H 60/54 725/61
2013/0162467 A1* 6/2013 Winther ..... G01S 19/42 342/357.25

(Continued)

*Primary Examiner* — Masud Ahmed
(74) *Attorney, Agent, or Firm* — Young Law Firm, P.C.

(57) ABSTRACT

A method for monitoring golfers on a golf course is provided comprising the steps of: providing a memory device to each golfer authorized to be on course, the memory device having unique identifier; receiving, at a first memory device reader positioned at a first reader location on course, the unique identifier; transmitting the unique identifier together with a first reader identifier and a first time stamp to a base station receiver; ascertaining a number of authorized golfers on course based on the number of unique identifiers transmitted to the base station receiver within a specified period of time; capturing one or more images, using a camera positioned at a camera location, each image associated with a camera time stamp; analyzing the one or more images to ascertain a number of golfers on course within the specified period of time; and comparing the number of authorized golfers on course according to step (d) to the number of golfers on course determined according to step (f) to establish whether the number of golfers determined by the two methods correspond. A system for monitoring golfers on a golf course is also provided.

19 Claims, 5 Drawing Sheets

(56) References Cited

U.S. PATENT DOCUMENTS

| | | | | |
|---|---|---|---|---|
| 2013/0225309 | A1* | 8/2013 | Bentley | G06K 9/00342<br>473/266 |
| 2013/0234842 | A1* | 9/2013 | Leitz | A63B 71/0669<br>340/323 R |

* cited by examiner

METHODS AND SYSTEMS FOR MONITORING GOLFERS ON A GOLF COURSE

FIELD OF THE INVENTION

The present invention relates to methods and systems for monitoring golfers on a golf course. In particular, the present invention provides means to monitor the presence of unauthorised golfers on course. Moreover, in some embodiments the present invention provides a method and system for monitoring the pace of play on a golf course.

BACKGROUND TO THE INVENTION

A major issue facing golf course operators is pace of play. As the number of golfers on course increases, so does the time taken to complete a round of golf. While numerous groups of golfers can play on the same course simultaneously, a safe distance must be maintained between each group to prevent the group in front from being struck by a ball hit by the following group.

If a group of golfers plays at a pace that is slower than the course average, they will inadvertently force every following group to play at their reduced pace. This results in congestion on course and a less than optimum utilization of golf courses by the greatest number of golfers. By maintaining a minimum pace of play, golf course operators can accommodate more golfers on course at any given time and correspondingly generate higher revenues.

Slow pace of play is regarded by many golfers as one of the most frustrating aspects of the game. Accordingly, if the pace of play could be improved, both golfers and golf course operators would benefit. The game would be more enjoyable for golfers and more profitable for the golf clubs. Consequently, monitoring pace of play to keep golfers moving at a pace that will enable them to meet course specific target times for completion of their rounds is a priority for many golf course operators.

Various measures have been adopted to improve pace of play. These include employing course marshals to identify slow players and approach them with a view to encouraging them to increase their pace of play. Course marshalling is resource intensive and inefficient and may be regarded by golf course marshalls and players alike as being confrontational which imparts a negative vibe on course. Other steps such as encouraging golfers to use golf carts have been found to have a minimal effect on increasing pace of play.

Another considerable issue is course access by non authorised, typically non-paying golfers. That is, not all golf courses are protected by a boundary fence, for example, a golf course integrated within a residential estate, and therefore it can be difficult to prevent access to the golf course by non-authorised golfers.

Paying players will generally be golf club members or visitors. The fee structure and access rights applied to these two categories of paying players will vary. For example, members typically have broad access rights to the golf course and club facilities, whilst visitor's access rights are generally restricted, e.g. a visitor must be accompanied by a member. Some golf clubs offer different level of membership, for example a full fee paying member might have unrestricted access rights, whereas a non-playing member might pay a reduced membership fee to have access to club facilities such as the clubhouse and golf shop, but be required to pay an additional green fee to play an occasional round of golf.

It is virtually impossible to distinguish between paying and non-paying golfers on course without directly asking each golfer whether they have paid their green fees. Accordingly, there is a need for means to discretely identify golfers who have not paid their green fees.

SUMMARY OF THE INVENTION

According to an aspect of the present invention, there is provided a method for monitoring golfers on a golf course, the method comprising the following steps: providing a memory device to each golfer authorised to be on course, the memory device having unique identifier; receiving, at a first memory device reader positioned at a first reader location on course, the unique identifier; transmitting the unique identifier together with a first reader identifier and a first time stamp to a base station receiver; ascertaining a number of authorised golfers on course based on the number of unique identifiers transmitted to the base station receiver within a period of time; capturing one or more images, using a camera positioned at a camera location, each image associated with a camera time stamp; analysing the one or more images to ascertain a number of golfers on course within the a period of time; and comparing the number of authorised golfers on course according to step (d) to the number of golfers on course determined according to step (f) to establish whether the number of golfers correspond.

In one embodiment the method further comprises the steps of step of generating an alert if the number of golfers on course determined by analysing the one or more images to ascertain a number of golfers on course within the period of time does not correspond to the number of golfers on course determined by the number of unique identifiers transmitted to the base station receiver within the same period of time.

Preferably, an alert is generated if the number of golfers on course determined by analysing the images to ascertain a number of golfers on course in the period of time exceeds the number of golfers on course determined by the number of unique identifiers transmitted to the base station receiver in the same period of time.

In the event that the number of golfers on course determined by the two means do not correspond, the alert may be accompanied by an approximate on course location of a group golfers whose numbers determined by analysing the one or more images exceeds the number of golfers on course determined by the number of unique identifiers transmitted to the base station receiver.

According to one embodiment, the method further comprises the steps of receiving, at a second memory device reader positioned at a second reader location on course, the unique identifier; transmitting the unique identifier together with a second reader identifier and a second time stamp to the base station receiver; and ascertaining a pace of play achieved by the golfer between the first reader and the second reader and extrapolating an anticipated pace of play over the entire course.

According to another aspect of the present invention, there is provided a system for monitoring golfers on a golf course, the system comprising: a memory device associated with each golfer authorised to be on course, the memory device having unique identifier; at least one memory device reader located on the golf course; a transmitter associated with each memory device reader; a base station receiver for receiving data transmitted from the plurality of memory device readers; a camera positioned at camera location for capturing one or more images; and a processor for ascertaining the number of golfers authorised to be on course at a particular time according to a number of unique identifiers transmitted to the base station receiver in a period of time; and further analysing the one or more images captured by the camera to determine a count of golfers that appear in the images captured during the same period of time.

In one embodiment, the count of golfers appearing in the images is used to verify that the number of golfers on course as determined by the number of unique identifiers transmitted to the base station receiver within a period of time corresponds to the count of golfers appearing in the images captured in the same period of time.

The system may further comprise an alert component that generates an alert if the number of golfers on course as determined based on the number of unique identifiers transmitted to the base station receiver within the period of time fails to correspond to the count of golfers appearing in images captured during the same period of time. The alert component may emit a visual or an audible alert.

At least one memory device reader distributed on the golf course may comprise a plurality of memory device readers distributed at known locations around the golf course, each known location being strategically determined to provide a desirable level of course coverage.

In accordance with an embodiment, the processor further determines a pace of play achieved by the golfer by determining the time taken by the golfer between a first memory device reader and a second memory device reader distributed at known locations and extrapolating an anticipated pace of play over the entire course.

Preferably, the memory device is attached to a golf bag or a golf cart associated with the golfer.

In one particular embodiment, the plurality of memory device readers distributed at known locations around the golf course includes a minimum of three memory device readers.

The memory device may include an integrated circuit for storing and processing data and an antenna for transmitting and receiving a signal.

In one particular form of the invention, the memory device is a radio frequency identification device. The memory device may be a passive radio frequency identification device.

Preferably, the memory device readers are distributed at known locations around the golf course in an inconspicuous manner. According to one embodiment, the memory device readers are buried underground. The memory device reader may be buried within a housing.

BRIEF DESCRIPTION OF THE DRAWINGS

It will be convenient to hereinafter describe the invention in greater detail by reference to the accompanying figures which facilitate understanding of the present invention. The particularity of the figures and the related description is not to be understood as superseding the generality of the broad identification of the invention as given in the attached claims.

DETAILED DESCRIPTION

Figure 1:
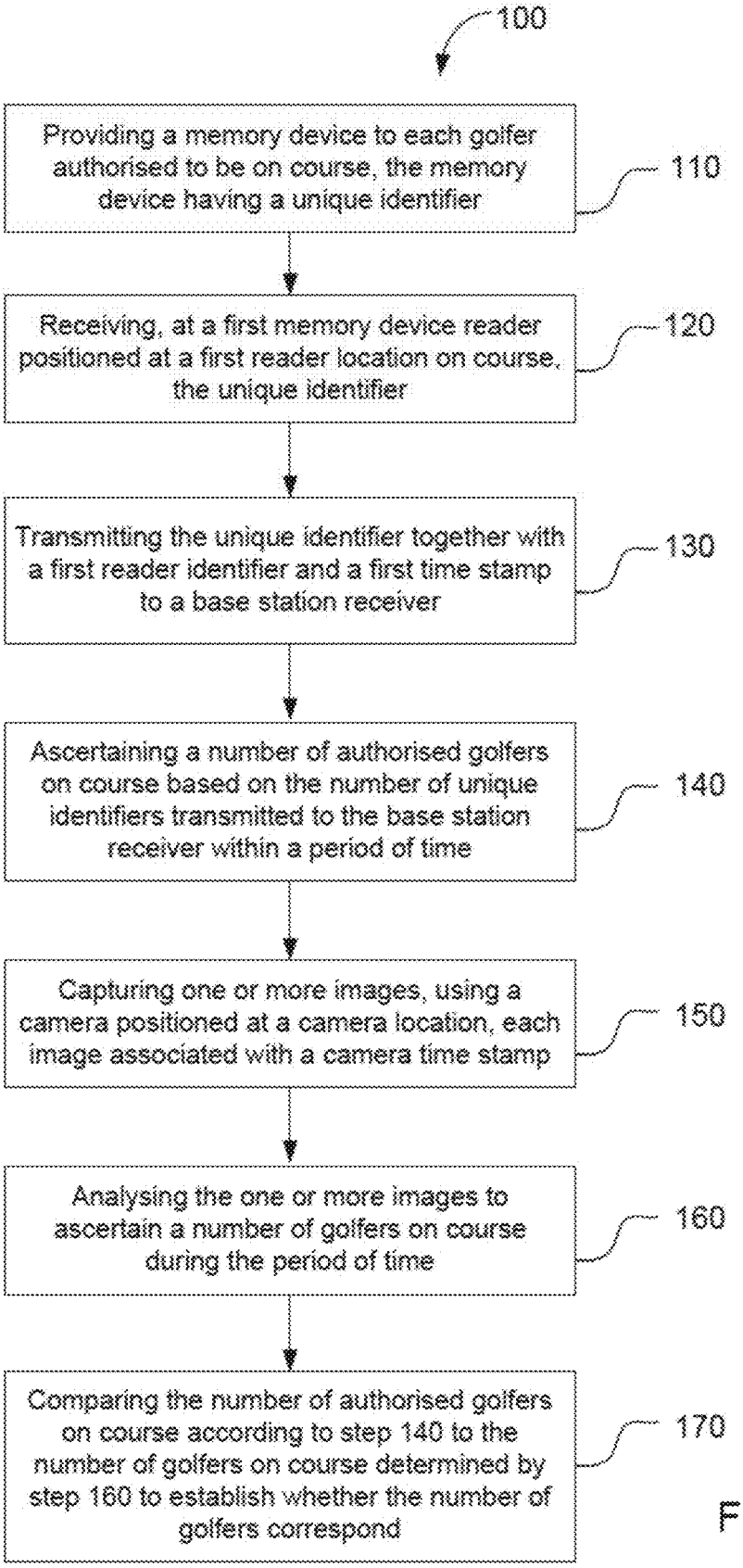
FIG. 1 is a flowchart of the method of the present invention.

Referring firstly to FIG. 1, there is provided a method for monitoring golfers on a golf course 100. At step 110, the method includes providing a memory device to each golfer authorised to be on course. Typically, a golfer authorised to be on course will be a paying golfer, i.e. member of the golf club or a visitor introduced by a member of the golf club. The memory device provided to the golfer has a unique identifier, e.g. associated with a membership number or other identifying features.

At step 120, a first memory device reader positioned on course at a first reader location, receives the unique identifier from the memory device associated with the golfer. The unique identifier is then transmitted to a base station receiver together with a first reader identifier and a first time stamp at step 130. Steps 120 and 130 provide a record of when a golfer associated with the unique identifier was in the physical vicinity of the first reader.

At step 140, a number of authorised golfers on course is based on the number of unique identifiers transmitted to the base station receiver during a period of time. One or more images are captured at step 150, using a camera positioned at camera location on course. Each image includes a camera time stamp, to enable the image to be placed at a specific moment in time. At step 160, the images are analysed to ascertain a number of golfers on course within the same period of time referred to in reference to step 140. This analysis may involve a process of visual (i.e. manual) recognition or may be an automated process using suitable software such as a video analytics algorithm for counting people.

At step 170, the number of authorised golfers on course according to the image analysis is compared with the number of golfers as determined by the number of unique identifiers transmitted to the base station receiver. The comparison is intended to establish whether the number of golfers determined by the two methods correspond.

In the event that there is a lack of correspondence between the counts produced by the alternate methods, an alert is generated to notify golf course operations personnel a potential issue exists. For instance, if the number of golfers counted using the memory devices, exceeds the number of golfers counted using video analytics, this might indicate a potential problem or inaccuracy in the system. If the number of golfers counted using the memory devices, is less than the number of golfers counted using the video analytics, then this might indicate that some golfers are not associated with a memory device and accordingly, their presence on course is likely to be unauthorised.

The method described with reference to FIG. 1, can be supplemented by providing a plurality of memory readers on course, such that a second memory device reader positioned on course at a second reader location, receives the unique identifier from the memory device associated with the golfer at a time subsequent to the moment in time when the first memory device reader positioned on course at a first reader location, will receive the unique identifier from the memory device associated with the golfer.

The unique identifier is transmitted to a base station receiver together with a second reader identifier and a second time stamp. This provides a record of when a golfer associated with the unique identifier was in the physical vicinity of the second reader.

A pace of play achieved by the golfer between the first reader and the second reader can be ascertained from the data captured by a plurality of memory device readers. Once the actual pace of play between the first and second readers is known, it can be extrapolated to provide an anticipated pace of play over the entire course.

Figure 2:
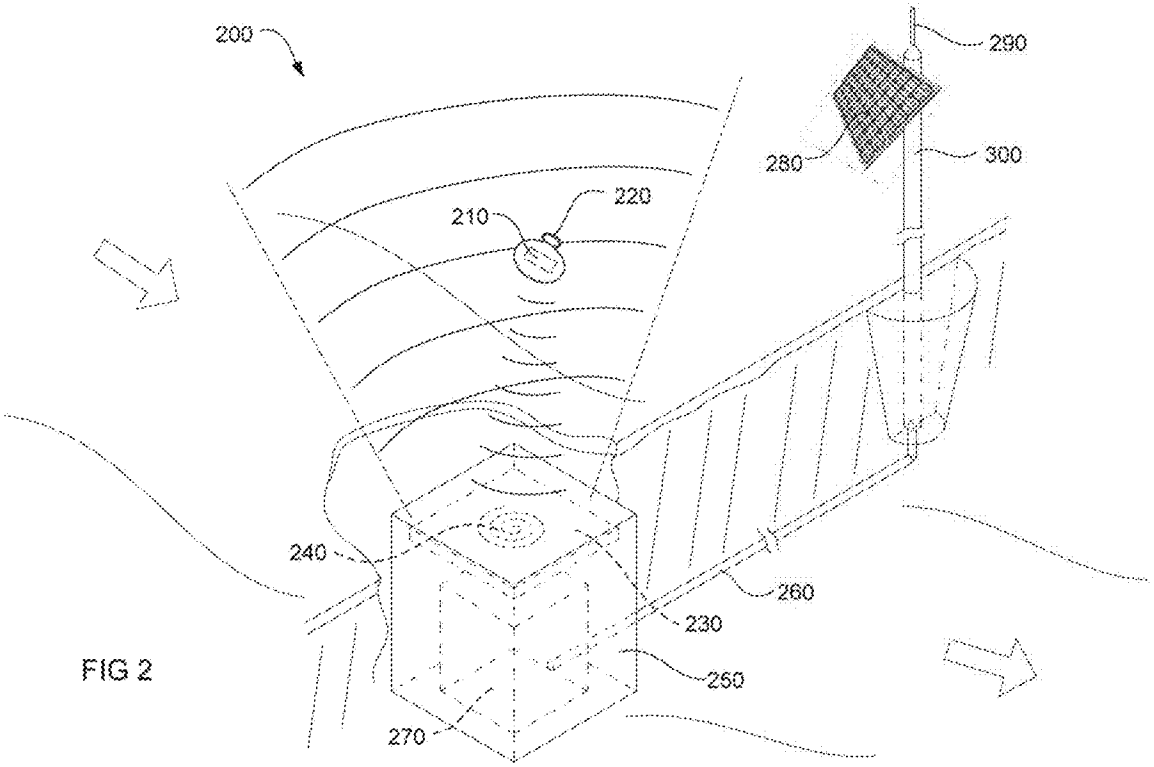
FIG. 2 is a schematic drawing showing aspects of the system of the present invention according to an embodiment.

Referring now to FIG. 2, there is provided a system 200 for implementing the method of the present invention. A memory device 210 having unique identifier is provided to each authorised golfer on course. The memory device 210 may be incorporated into a tag 220 for attachment to a golfer's golf bag or even to a golf cart (not shown), although a golf cart is likely to carry more than one golfer. The memory device 210 includes an integrated circuit for storing and processing data, i.e. such as the unique identifier which is used to access a database record associated with the golfer. This database record may for example contain data relating to the golfer's name, address, contact details, membership status, play history and payment history.

The memory device 210 is generally course specific but maybe able to be used at associate golf course using the same or similar systems for tracking golfers on course.

The memory device 210 further includes an antenna for transmitting and receiving a signal. In one particular embodiment, the memory device 210 is a radio frequency identification device (RFID) although it is envisaged that the memory device could comprise any device providing analogous function. Generally, the memory device 210 will be a passive RFID device with no requirement for power within the device 230 including an antenna 240.

The system 200 further includes a plurality of memory device readers 230. The memory device readers 230 are distributed around the golf course at strategically determined locations to provide a desirable level of coverage over the course. The locations of the memory device readers 230 will be known to golf course operators.

The memory device reader 230 will preferably be in an inconspicuous location. For instance, the memory device reader 230 is buried under a shallow amount of soil and grass (say approximately 5 to 10 cm) with the antenna 240 upwardly facing. Alternately, if the memory device reader 230 were positioned on/under a gravel or concrete path, then it would be covered with a grating, plastic cover or similar structure.

The memory device reader 230 may be encased in a housing 250. Such a housing 250 should be rated IP 67 or similar and will contain at least the memory device reader 230 and a cable connection 260. The housing 250 may further contain a power source 260 such as a battery to maintain a time stamp and other required functions of the microprocessor. Such an ancillary power source 270 will be required in the event that 12V or mains power is not readily available in this location. It is to be understood that the power source 270 could be alternately located. Another option to provide a power source is a proximally located photovoltaic panel 280. A battery may be mounted on the same support structure as the photovoltaic panel.

The material used to form the housing 250 should be such so as to enable the housing to be buried in all soil types and resistant to corrosion (including the effects of acidic soils, etc.). Preferably, the housing 250 will be buried within a plastic sheath (not shown) and be buried at sufficient depth to avoid disruption from golf players above, whilst maintaining the ability to adequately read memory devices 210, for example passive RFIDs, at, their maximum range (currently around a 5 to 10 m radius).

A transmitter 290 provided in the vicinity of each memory device reader 230 is provided to wirelessly transmit data collected by the memory device reader to the base station receiver (not shown, See FIG. 4) via a suitable wireless network such as WiFi, 3G/4G or similar. The base station receiver is preferably located near the clubhouse 440 (see also FIG. 4). Where a photovoltaic panel is provided as the power source 280, it may be convenient to locate the photovoltaic panel and the transmitter on the same pole 300.

Also typically located in the clubhouse 440 (see FIG. 4), although it could equally be located offsite, is a computer system including a processor for processing the data transmitted to the base station receiver. The processor processes the data in accordance with an algorithm to ascertain the pace of play achieved by a golfer by determining the time taken by the golfer between the first and second memory device readers. The pace of play between the first and second memory device readers is then extrapolated to an anticipated pace of play over the entire course. This assumes that that the pace of play between the first and second memory device readers is representative of an average pace of play that will be achieved over the entire course.

In order to calibrate the system, a golf course operator arranges for one or more rounds of golf to be played to establish a desirable pace of play between the memory device readers positioned on course. These one or more calibration rounds can be used to determine a lower threshold pace of play at which an alert is triggered to be emitted to notify the golf course operator that the pace of play is below a desirable level.

It is to be understood that a more accurate representation of the pace of play over the entire course can be readily achieved by increasing the number of memory device readers on course. A minimum of three memory device readers permits an increased level of confidence in the pace of play ascertained for a particular golfer.

Figure 3:
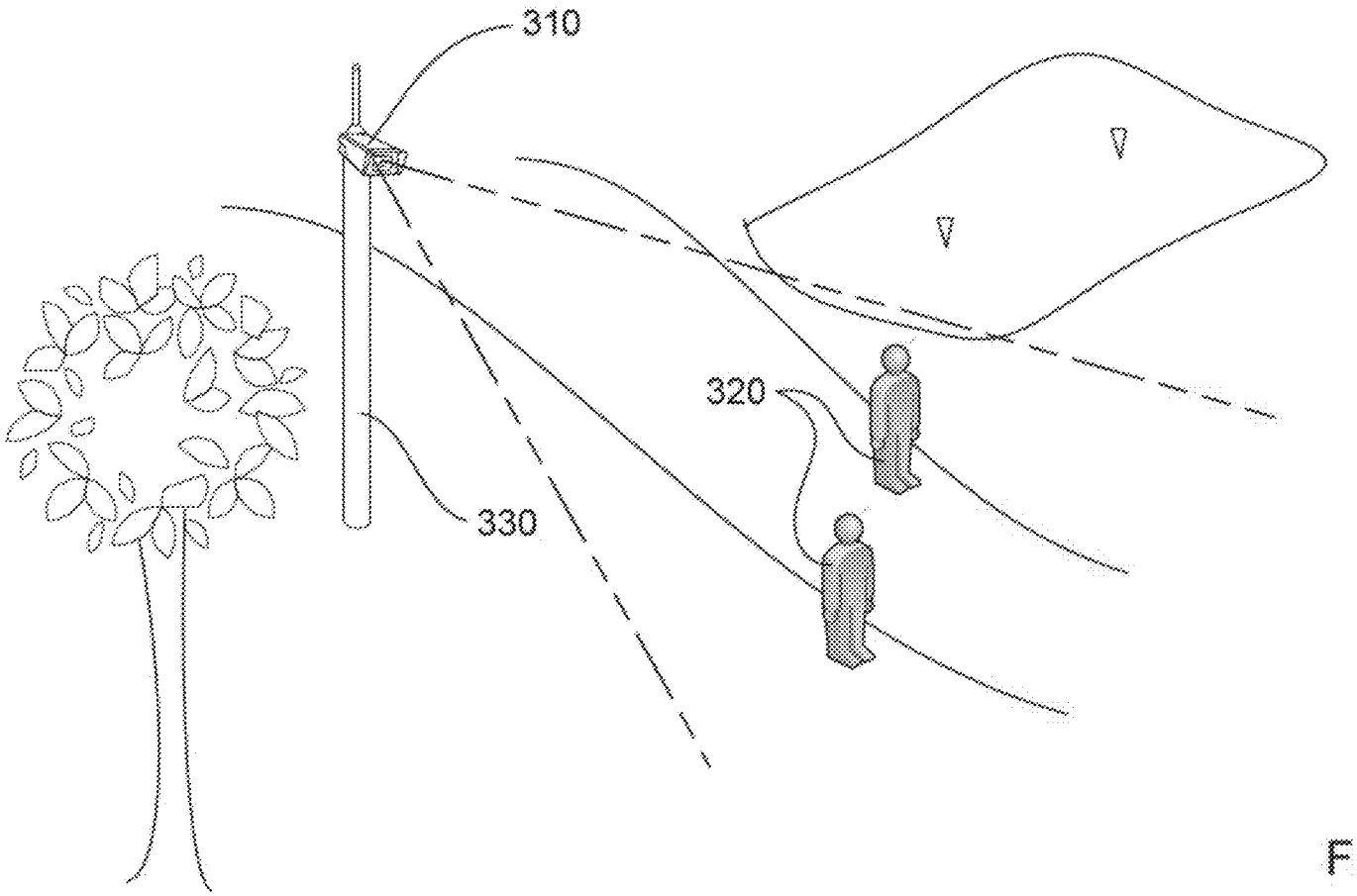
FIG. 3 is a schematic drawing another aspect of the system of the present invention according to an embodiment.

Referring now to FIG. 3, there is shown a representation of a camera 310 which is positioned on course to ensure that there is a high likelihood that a golfer 320 on course will be captured in the field of view of the camera whilst on course. The camera 310 is preferably a CCTV video camera. The camera 310 is also linked to the base station receiver located at the clubhouse 440 via the wireless network. The camera 310 is mounted on a pole 320 or similar elevated structure, such as a permanent building to prevent the camera being tampered with.

A sequence of images captured by the camera are each associated with a time stamp. This sequence of images is processed referable using suitable software such as a video analytics algorithm for counting people. The algorithm determines the number of people appearing within each image. This software may be provided on board the camera 310 or may be provided at an alternate location. Preferably, the software is provided on board the camera 310 such that the data transmitted to the base station receive is simply a people count together with a time stamp.

Given that each people count is associated with a time stamp, a comparison can be made between the number of golfers 320 in the vicinity based on the number of unique identifiers transmitted to the base station receiver within a specified period of time, i.e. identifying the authorised golfers which are associated with a memory device, and the number of people captured in the images which represents the total number of people on course.

Any discrepancy between the two counts, indicates either that there is a problem with the system causing an incorrect reading, or alternately indicates that there are unauthorised persons present on course. The system includes an alert component (not shown) that emits an alert if the number of golfers on course as ascertained based on the number of unique identifiers transmitted to the base station receiver within a period of time fails to correspond to the count of golfers 320 appearing in the images captured by the on course camera. The alert component emits a visual or an audible alert.

The golf course operator may be provided with one or more mobile memory device readers to assist in identifying golfers on course. For instance, if an alert is generated to notify golf course operators that a group of golfers is behind the desirable pace of play, or includes a non-authorised golfer in their midst, then a course marshal equipped with a mobile memory device reader can readily identify the group of golfers based on one or more unique identifiers associated with the group of golfers according to data transmitted back to the base station. Corrective action can then be directed at the responsible golfer.

The camera 310 is strategically positioned on course to ensure that any golfer 320 on course will be captured in the camera view. This will generally be a location on course that all golfers will pass through, and where golfers will usually pass in just one direction.

Figure 4:
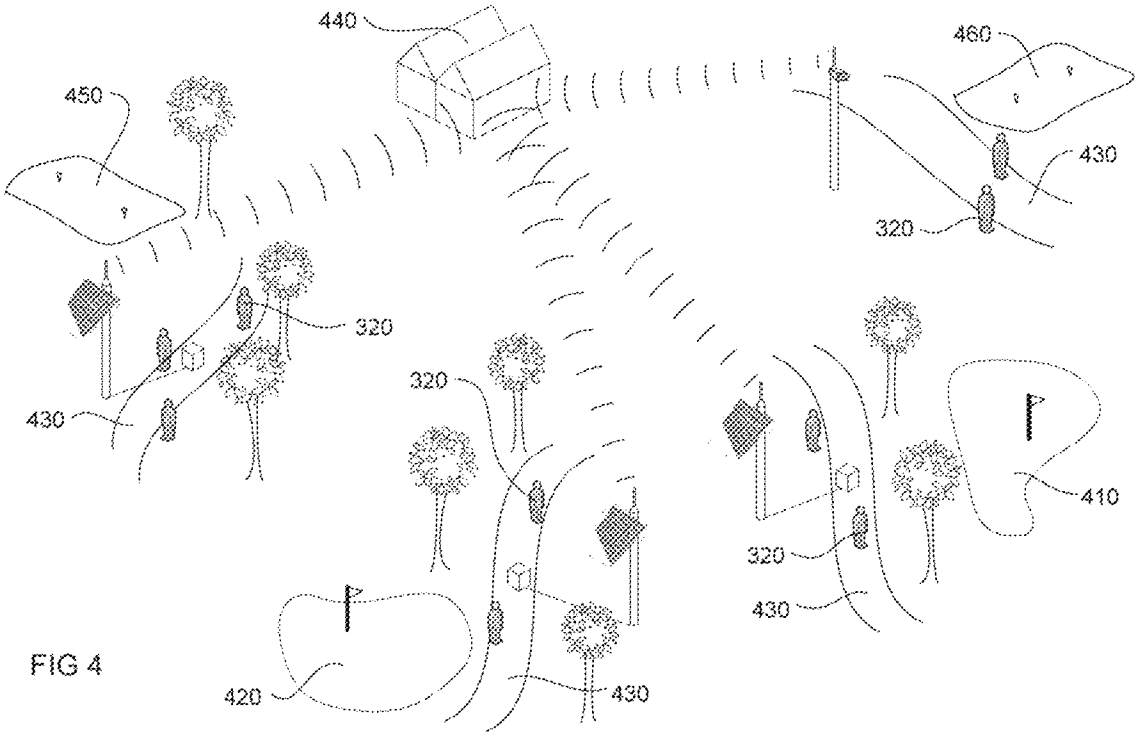
FIG. 4 is a schematic drawing showing the distribution of aspects of the system of the present invention over an exemplary golf course.

Referring now to FIG. 4, there is shown a schematic representation of a golf course 400 with three memory device readers distributed at strategic locations on course. A typical golf course 400 includes holes 410, 420, paths 430 and a clubhouse 440. The clubhouse 440 typically contains offices for the golf course operator and other personnel and a golf shop which sells and hires golf equipment. Golfers will usually enter the clubhouse 440 before playing a round of golf.

In each case, the memory device reader 230 is located in the vicinity of a hole 410, 420 or tee box 450, 460, green or well defined path 430. This means that there is a very high likelihood that each golfer 320 will pass sufficiently close to the memory device reader 230 to permit the memory device reader to read the memory device 210 associated with the golfer 320. The positioning of the memory devices 230, is therefore strategic, since the memory device readers must be positioned so as to ensure that the vast majority of golfers 320 on course would pass within sufficient proximity of the memory device readers to permit the memory device to be read. To provide optimal course coverage, three memory device readers 230 could for example be positioned in proximity to the $6^{th}$, $12^{th}$ and $18^{th}$ holes on a golf course.

Referring back to FIG. 4, the system 200 may be implemented using hardware, software or a combination thereof and may be implemented in one or more computer systems or processing systems. In particular, the functionality of the processor provided at the base station, may be provided by one or more computer systems capable of carrying out the above described functionality.

Figure 5:
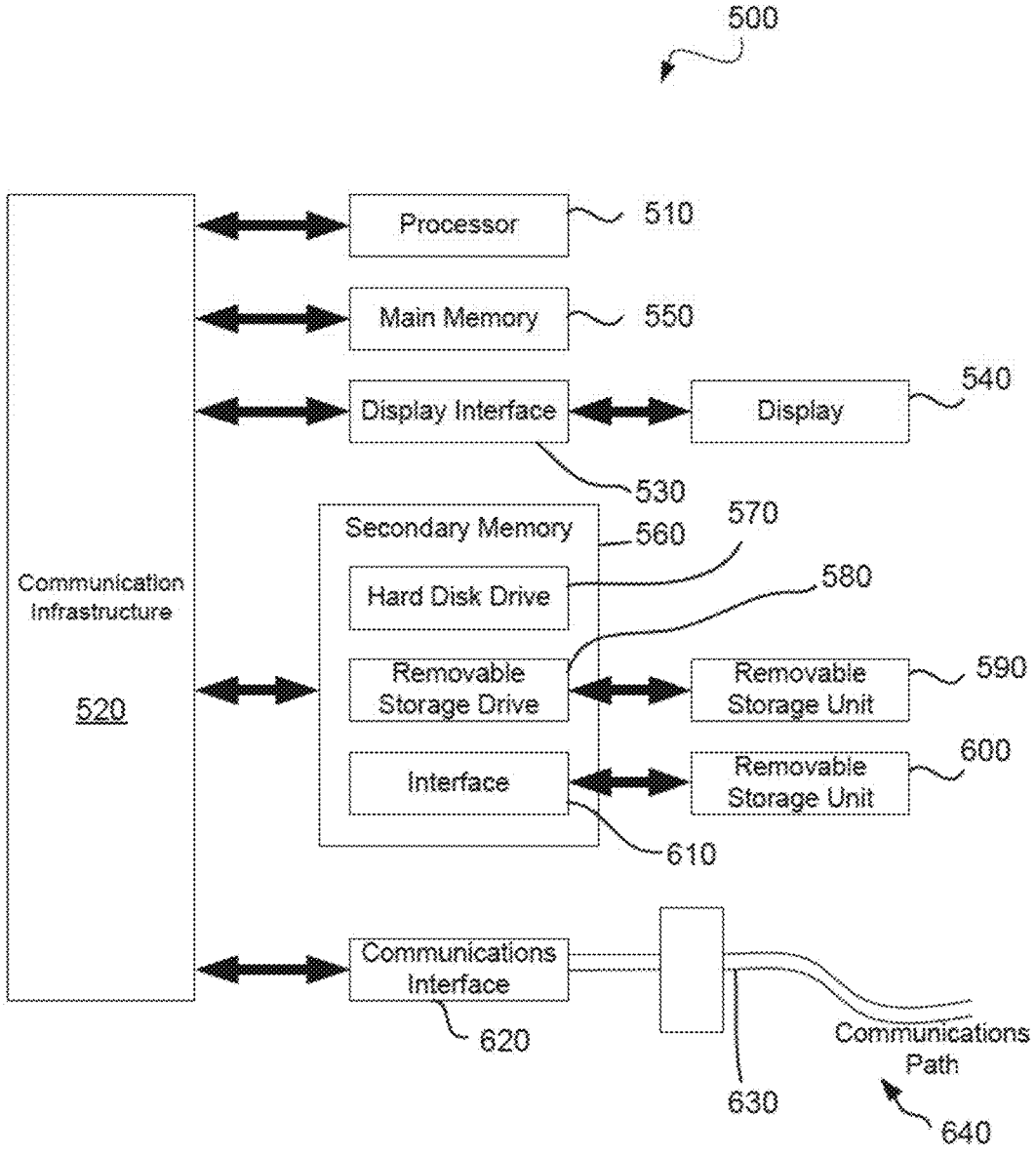
FIG. 5 is a schematic of a computer system used to implement aspects of the method of the present invention.

Such a computer system is illustrated in FIG. 5. In this Figure, an exemplary computer system 500 includes one or more processors, such as processor 510. The processor 510 is connected to a communication infrastructure 520. The computer system 500 may include a display interface 530 that forwards graphics, texts and other data from the communication infrastructure 520 for supply to the display unit 540. The computer system 500 may also include a main memory 550, preferably random access memory, and may also include a secondary memory 560.

The secondary memory 560 may include, for example, a hard disk drive 570, magnetic tape drive, optical disk drive, etc. The removable storage drive 580 reads from and/or writes to a removable storage unit 590 in a well-known manner. The removable storage unit 590 represents a floppy disk, magnetic tape, optical disk, USB etc.

As will be appreciated, the removable storage unit 490 includes a computer usable storage medium having stored therein computer software in a form of a series of instructions to cause the processor 510 to carry out desired functionality. In alternative embodiments, the secondary memory 560 may include other similar means for allowing computer programs or instructions to be loaded into the computer system 500. Such means may include, for example, a removable storage unit 600 and interface 610.

The computer system 500 may also include a communications interface 620. Communications interface 620 allows software and data to be transferred between the computer system 500 and external devices. Examples of communication interface 620 may include a modem, a network interface, a communications port, a PCMIA slot and card etc. Software and data transferred via a communications interface 620 are in the form of signals 630 which may be electromagnetic, electronic, optical or other signals capable of being received by the communications interface 520. The signals are provided to communications interface 620 via a communications path 640 such as a wire or cable, fibre optics, phone line, cellular phone link, radio frequency or other communications channels.

Although in the above described embodiments the invention is implemented primarily using computer software, in other embodiments the invention may be implemented primarily in hardware using, for example, hardware components such as an application specific integrated circuit (ASICs). Implementation of a hardware state machine so as to perform the functions described herein will be apparent to persons skilled in the relevant art. In other embodiments, the invention may be implemented using a combination of both hardware and software.

It is an advantage of the present invention that golf course operators are provided with a means to monitor pace of play on course to enable them to optimise pace of play. Aspects of the system provide for optimisation of different aspects of golf course management and enable capture of data for statically analysis. In some embodiments alerts are provided to notify a golf course operator that there are one or more unauthorised payers on course, too many golfers in one group, or a slow pace of play. The ability to monitor and identify these issues allows golf course operators to address problems, thereby optimising operations and reducing lost revenue.

While the invention has been described in conjunction with a limited number of embodiments, it will be appreciated by those skilled in the art that many alternative, modifications and variations in light of the foregoing description are possible. Accordingly, the present invention is intended to embrace all such alternative, modifications and variations as may fall within the spirit and scope of the invention as disclosed.

The invention claimed is:

1. A method for monitoring golfers on a golf course, the method comprising:

(a) providing a memory device to each golfer authorized to be on course, the memory device having unique identifier;

(b) receiving, at a first memory device reader positioned at a first reader location on course, the unique identifier;

(c) transmitting the unique identifier together with a first reader identifier and a first time stamp to a base station receiver;

(d) ascertaining a number of authorized golfers on course based on the number of unique identifiers transmitted to the base station receiver within a specified period of time;

(e) capturing one or more images, using a camera positioned at a camera location, each image associated with a camera time stamp;

(f) analyzing the one or more images to ascertain a number of golfers on course within the specified period of time; and (g) comparing, using a processor, the number of authorized golfers on course at (d) to the number of golfers on course determined at (f) to determine whether a discrepancy exists between the number of authorized golfers on course and the number of golfers on course determined by image analysis.

2. A method according to claim 1, further comprising generating an alert if the number of golfers on course as determined at (f) does not correspond to the number of golfers on course as determined at (d).

3. A method according to claim 2, further comprising generating an alert if the number of golfers on course as determined at (f) exceeds the number of golfers on course as determined at (d).

4. A method according to claim 3, further comprising providing an approximate on course location of a group golfers whose numbers as determined at (f) exceeds the number of golfers on course as determined at (d).

5. A method according to claim 1, further comprising:

(a) receiving, at a second memory device reader positioned at a second reader location on course, the unique identifier;

(b) transmitting the unique identifier together with a second reader identifier and a second time stamp to the base station receiver; and (c) ascertaining a pace of play achieved by the golfer between the first reader and the second reader and extrapolating an anticipated pace of play over the entire course.

6. A system for monitoring golfers on a golf course, the system comprising:

(a) a memory device associated with each golfer authorized to be on course, the memory device having unique identifier;

(b) at least one memory device reader distributed on the golf course;

(c) a transmitter associated with each memory device reader;

(d) a base station receiver for receiving data transmitted from the memory device readers;

(e) a camera for capturing one or more images; and (f) a processor configured to ascertain the number of golfers authorized to be on course at a particular time according to the number of unique identifiers transmitted to the base station receiver within a specified period of time; the processor being further configured to analyze the one or more images captured by the camera to determine a count of golfers that appear in the camera field of view; and to compare the number of golfers authorized on course to the count of golfers appearing in the camera field of view to determine whether any discrepancy exists between them.

7. A system according to claim 6, wherein the processor is further configured to verify that the number of golfers on course as ascertained based on the number of unique identifiers transmitted to the base station receiver within a specified period of time corresponds to the count of golfers appearing in the camera field of view.

8. A system according to claim 7, further comprising an alert component that produces an alert if the number of golfers on course as ascertained based on the number of unique identifiers transmitted to the base station receiver within a specified period of time fails to correspond to the count of golfers appearing in the camera field of view.

9. A system according to claim 8, wherein the alert component produces a visual or an audible alert.

10. A system according to claim 6, wherein the at least one memory device reader distributed on the golf course comprises a plurality of memory device readers distributed at known locations around the golf course, each known location being determined to provide a desirable level of course coverage.

11. A system according to claim 10, wherein the processor is further configured to ascertain a pace of play achieved by the golfer by determining the time taken by the golfer between a first memory device reader and a second memory device reader distributed at known locations and extrapolating an anticipated pace of play over the entire course.

12. A system according to claim 6, wherein the memory device is configured attach to a golf bag or a golf cart associated with the golfer.

13. A system according to claim 10, wherein the plurality of memory device readers distributed at known locations around the golf course includes a minimum of three memory device readers.

14. A system according to claim 6, where the memory device includes an integrated circuit for storing and processing data and an antenna for transmitting and receiving a signal.

15. A system according to claim 14, wherein the memory device comprises a radio frequency identification device.

16. A system according to claim 15, wherein the memory device comprises a passive radio frequency identification device.

17. A system according to claim 10, wherein the plurality of memory device readers are distributed at known locations around the golf course.

18. A system according to claim 17, wherein at least one of the plurality of memory device readers is configured to be buried underground.

19. A system according to claim 18, wherein at least one of the plurality of memory device readers is configured to be buried within a housing.

* * * * *